United States Patent [19]

Adolfsson et al.

[11] 4,387,775

[45] Jun. 14, 1983

[54] ROCK DRILLING APPARATUS

[75] Inventors: Ebbe S. Adolfsson, Handen; Kurt H. Andersson, Tyresö; Carl G. B. Ekwall, Saltsjöbaden, all of Sweden

[73] Assignee: Atlas Copco Aktiebolag, Nacka, Sweden

[21] Appl. No.: 247,067

[22] Filed: Mar. 24, 1981

[30] Foreign Application Priority Data

Apr. 3, 1980 [SE] Sweden ..... 8002589

[51] Int. Cl.[3] ..... E21B 17/00; E21C 3/06; E21C 7/08

[52] U.S. Cl. ..... 175/135; 175/320; 173/131; 173/DIG. 2

[58] Field of Search ..... 175/135, 320, 215, 173, 175/171; 173/131, 104, 105, 106, 107, 108, 109, 110, 111, DIG. 2

[56] References Cited

U.S. PATENT DOCUMENTS

| | | | |
|---|---|---|---|
| 1,559,709 | 9/1920 | Knapp | 175/56 |
| 1,759,573 | 2/1928 | Hansen | 175/171 |
| 1,773,366 | 6/1929 | Lear | 173/111 |
| 2,956,783 | 10/1960 | Landstedt | 175/325 |
| 3,757,891 | 9/1973 | Krieger | 173/DIG. 2 |
| 3,981,368 | 9/1976 | Lundstrom et al. | 175/173 X |
| 4,094,364 | 6/1978 | Lundstrom et al. | 175/293 X |
| 4,108,258 | 8/1978 | Ekwall | 175/320 |

FOREIGN PATENT DOCUMENTS

| | | |
|---|---|---|
| 1014498 | 8/1957 | Fed. Rep. of Germany . |
| 1483874 | 9/1969 | Fed. Rep. of Germany . |
| 193176 | 12/1964 | Sweden . |
| 373410 | 2/1975 | Sweden . |
| 374781 | 3/1975 | Sweden . |

*Primary Examiner*—Ernest R. Purser
*Assistant Examiner*—Thuy M. Bui
*Attorney, Agent, or Firm*—Frishauf, Holtz, Goodman & Woodward

[57] ABSTRACT

Rock drilling apparatus including a pressure fluid driven rock drilling machine (10) and a drill unit (11). The drill unit (11) includes a drill rod (18), a drill bit (16) and a tube (20) surrounding the drill rod (18). The drill rod (18) has a collar (22) in front of a shank (21), the collar (22) maintaining the tube (20) rotatably therebetween and between the drill bit (16). The rock drilling machine (10) includes coupling device (46; 57), a socket means (42) and a rotation chuck (44) for receiving and holding the tube (20) and shank (21) connected to the machine (10), the tube (20) being radially spaced around the drill rod (18) and non-rotatably connected to the socket means (42).

11 Claims, 9 Drawing Figures

ROCK DRILLING APPARATUS

BACKGROUND OF THE INVENTION

The present invention relates to a rock drilling apparatus including a pressure fluid driven rock drilling machine having a percussive motor and a rotation chuck arranged in a housing, a drill rod connectable to said housing and having a drill bit and a shank, and a tube surrounding said rod, which tube has a rear adapter non-rotatably attached to the tube, the percussive action needed for the drilling being transmitted from the percussive motor to the drill bit by said drill rod.

When using a conventional rock drilling apparatus with a rotating drill rod there is often a risk that the operator's clothes or other things might come into contact with the drill rod and then, due to the rotation, be twisted around it. To avoid this, different arrangements have been proposed according to which the drill rod is equipped with a protective shielding which prevents direct contact with the rotating rod. These arrangements have, however, been of little use in practice since they are too complicated to handle and also require too much space.

SUMMARY OF THE INVENTION

An object of this invention is to provide a rock drilling apparatus with a drill rod having a non-rotatable outside tube which replaces the need for separate shieldings or other covering devices and which drill rod can be handled as one unit for example when connected to or disconnected from the drilling machine. Another object of the invention is to provide a rock drilling apparatus with good noise suppressing characteristics. Preferably this also is apt to improve the flushing of the drill hole. The above and other purposes are achieved by providing a drill steel and a drilling machine according to the accompanying claims.

DETAILED DESCRIPTION

Figure 1:
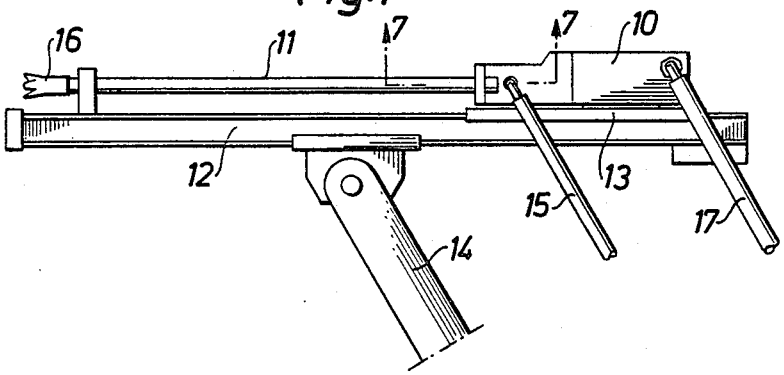
FIG. 1 is a side view of a rock drilling apparatus according to the invention arranged on a feed beam.

In FIG. 1 there is shown a rock drilling apparatus according to the invention. The apparatus includes a drilling machine 10 with a drill unit 11 arranged on a feed beam 12. The machine 10 is mounted on a cradle 13 which is displaceable along the feed beam 12. The beam 12 is carried by a boom 14 arranged on any suitable not shown chassis. A hose 15 is connected to the drilling machine 10 through which flushing medium is led in order to be transmitted to a drill bit 16 on the drill unit 11. Another hose 17 is adapted for supplying compressed air for running the machine 10 which however also can be hydraulically powered.

Figure 2:
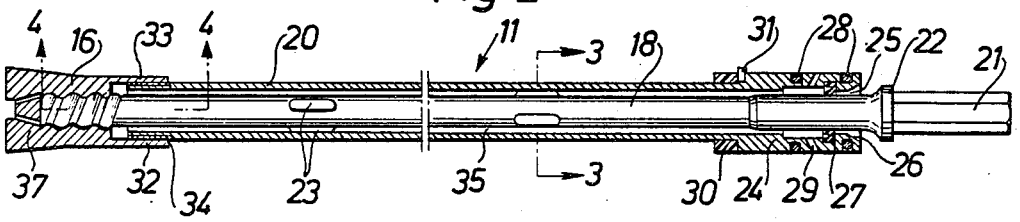
FIG. 2 is a longitudinal sectional view of a drill unit included in the rock drilling apparatus.
Figure 3:
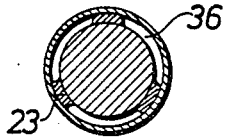
FIG. 3 is a cross sectional view taken along the line 3—3 in FIG. 2.

In FIG. 2 the drill unit 11 is shown in a position disconnected from the drilling machine 10. The drill unit 11 includes a central drill rod 18, the drill bit 16 tightly threaded on the drill rod 18 and a tube 20 surrounding the rod 18. The rod 18 is shaped in one piece as a shank rod and has a hexagonal shank 21 and a collar 22. On the drill rod 18 spacing cushions 23 of elastic material are attached, which cushions 23, as seen in FIG. 3, extend radially in three directions. The tube 20 has a rear adapter 24 with an internal clearance 25 around the drill rod 18 and a stop face 26 for the collar 22. A sealing ring 27 is arranged between the drill rod 18 and the adapter 24 and two sealing rings 28 are arranged on the outside of the adapter 24, one on each side of the inlets to radial channels 29 for the flushing medium. The adapter 24 also includes an elastic rubber ring 30 and a locking pin 31 whose functions will be described later.

A guide bushing 32 is arranged on the forward part of the tube 20, which bushing 32 preferably is made of anti-vibratory non-metallic material as for example TEFLON or the like. The guide bushing 32 is encircled by a sleeve shaped part 33 on the drill bit 16, said guide bushing 32 and the inside of the sleeve 33 forming a slide bearing 34 between the drill bit 16 and the rod 18. The bearing 34 is arranged also to permit mutual axial movement between the journalled parts.

Figure 4:
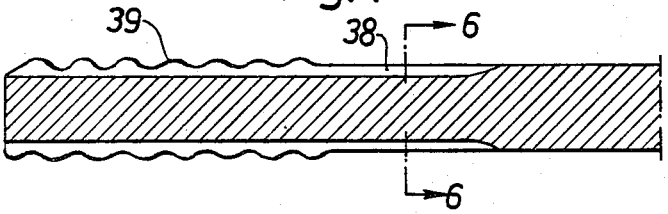
FIG. 4 is a longitudinal sectional view of the drill rod end taken along the line 4—4 in FIG. 2.
Figure 6:
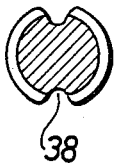
FIG. 6 is a cross sectional view taken along the line 6—6 in FIG. 4.
Figure 5:
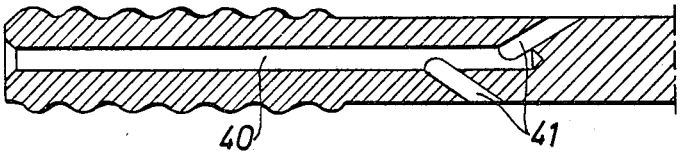
FIG. 5 shows an alternative embodiment of the rod end according to FIG. 4.

A continuous annular space 35 is created between the drill rod 18 and the tube 20, said space 35 being used for transmitting flushing medium to the drill bit 16. The flushing medium, preferably water, enters through the channels 29 and passes through spaces 36 between the cushions 23 and then further through a passage means in the front part of the rod 18 out to flushing holes 37 in the drill bit 16. Said passage means, whose arrangement appears from FIGS. 4 and 6, comprises two longitudinal grooves 38 in the periphery of the rod 18 and through the thread 39. An alternative embodiment is shown in FIG. 5 in which the passage is arranged by a central axial hole 40 with radial connecting holes 41. The annular space 35 between the rod 18 and the tube 20 is sealed partly by the sealing ring 27 and partly by making the bearing 34 between the drill bit 16 and the tube 20 essentially sealed.

The parts included in the drill unit 11; the drill rod 18, the tube 20, and the drill bit 16 are locked up to each other by screwing the drill bit 16 tight on the drill rod 18. There is, however, an axial play between the rod 18 and the tube 20, thus avoiding transmission of the percussion movement from the drill rod 18 to the tube 20 and enabling the necessary mutual movement between the drill rod 18 and the tube 20 if the drill unit 11 is bent. Said play is limited by the rod collar 22 and the drill bit 16 whose sleeve shaped part 33 has an axial extension exceeding the play, thus holding the tube 20 in the bit 16.

Figure 7:
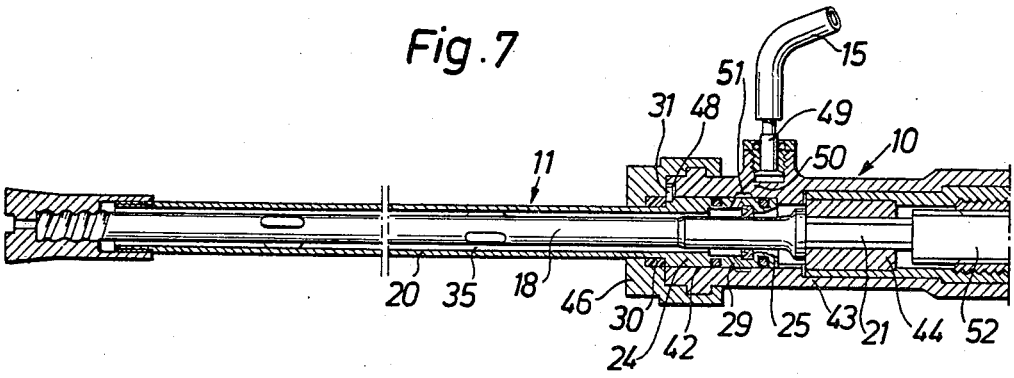
FIG. 7 is a longitudinal view taken along the line 7—7 in FIG. 1 showing the connection between the drill unit and the drilling machine.

In FIG. 7 the connection is shown between the drill unit 11 and the drilling machine 10. During the connecting operation the adapter 24 is inserted into a socket means 42 in the machine housing 43 and the rod shank 21 into a rotation chuck 44. The adapter rear 24 is centered by the socket means 42 to take a position radially spaced from the drill rod 18 leaving the internal clearance 25. The drill unit 11 is held in the connected position by a disconnectable coupling device 46 encircling the tube 20. The coupling device 46 is shown as a bayonet joint, but of course it is possible also to use other coupling devices. The rubber ring 30 is pressed to the coupling device 46 giving the tube 20 resilient characteristics in the longitudinal direction. The locking pin 31 attached to the adapter 24 is entered into a recess 48 in the socket 42 and prevents the tube 20 from rotating. The flushing water coming through the hose 15 is led into the drilling machine 10 by a hose coupling 49 and is guided through a channel 50 to an annular chamber 51 which is adapted to cover the inlets to the channels 29 in the adapter 24, thus enabling the water to be led into the annular space 35 in the drill unit 11. The drilling machine 10 has further a piston 52 and said rotation chuck 44 for transmitting percussive energy and rotation to the rod shank 21 in a common known way.

Figure 8:
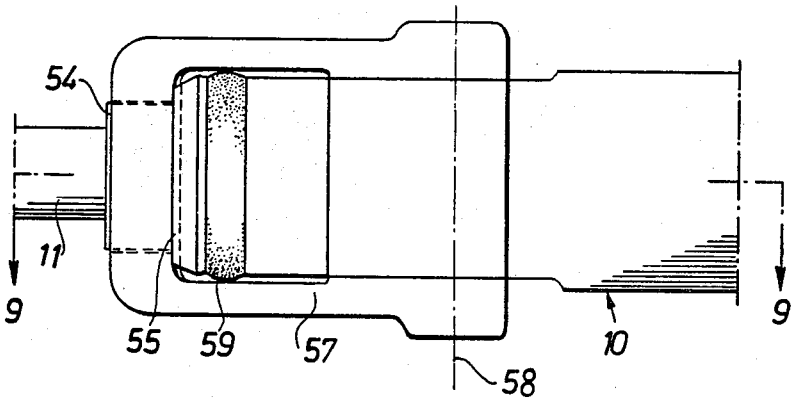
FIG. 8 is a plan view seen from above showing an alternative connection according to FIG. 7.
Figure 9:
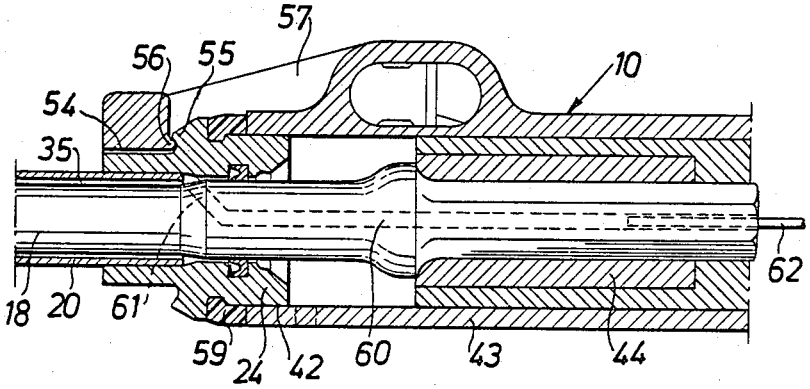
FIG. 9 is a longitudinal sectional view taken along the line 9—9 in FIG. 8.

In FIGS. 8 and 9 there is shown an embodiment especially adapted for hand-held drilling equipment comprising an alternative connection between the drilling machine 10 and the drill unit 11 and an alternative flushing water inlet. By these means the adapter 24 is made as a separate unit attached to the tube 20 and has a flat part 54 and a projecting part 55 for a snap-in cooperation with a protrusion 56 on a coupling device 57. The coupling device 57 is swingable in relation to the machine 10 around an axis 58 to a connecting and a disconnecting position. In the connecting position the coupling device 57 will be pressed against said flat part 54, thus preventing the adapter 24 and thereby the tube 20 from rotating. The mutual movement required for the snap-in movement is achieved by compressing a rubber ring 59 arranged between the adapter 24 and the machine housing 43. In the drill rod 18 there is a central flushing channel 60 which is connected with the annular space 35 by a radial connecting channel 61. The flushing water is led into the channel 60 in a conventional way through a flushing tube 62 in the machine 10.

From the foregoing described examples it is clear that the tube will not rotate when the drill unit is in use. This entails besides eliminating said risks of accident also other advantages. For example, it is possible to collar a hole and to guide the drill unit in a more exact manner in particular when using hand-held or pusher leg equipped machines, because the operator can grab the drill unit with one of his hands near the drill bit and guide the unit to the desired position. Further, the tube forming a surrounding cover around the drill rod, and having no metallic connections, will give the drilling apparatus good noise suppressing characteristics. If the flushing is separately arranged this will also mean that the flushing tube and the shank packing can be eliminated, which in turn makes it possible to raise the flushing pressure. Finally, it is clear that the drill unit will be easy to handle as one unit, for example when connected to or disconnected from the drilling machine.

It is to be understood that the invention is not limited to the described examples but can be varied in many ways within the scope of the following claims.

We claim:

1. Rock drilling apparatus comprising:

a pressure fluid driven rock drilling machine (10) having a percussive motor and a rotation chuck (44) arranged in a housing (43);

a drill rod (18) connectable to said housing (43) and having a drill bit (16) at one end of said drill rod (18) and a shank (21) at the other end of said drill rod (18), said drill bit (16) being spaced from said housing;

a tube (20) surrounding said drill rod (18) and extending from said drill bit (16) to said housing (43), said tube (20) having a rear adapter (24) nonrotatably attached to said tube (20);

the percussive action needed for the drilling being transmitted from said percussive motor to said drill bit (16) by said drill rod (18);

a collar (22) projecting from said drill rod (18) in front of said shank (21), said tube (20) extending between said collar (22) and said drill bit (16);

guiding means (33) on said drill bit (16) for maintaining said tube (20) rotatably between said drill bit (16) and said collar (22);

socket means (42) on said drilling machine (10) for receiving said rear adapter (24) therein with said rear adapter centered in a position radially spaced around said drill rod (18);

said shank (21) non-rotatably extending into said rotation chuck (44);

a disconnectable coupling device (46; 57) for maintaining said rear adapter (24) in said socket means (42); and means (31; 55) for preventing relative rotation between said socket means (42) and said rear adapter (24) during operation of said percussive motor.

2. The rock drilling apparatus of claim 1, wherein said guiding means (33) includes means for holding said tube (20) radially spaced from said drill rod (18) thereby forming an annular space (35) between said tube and said drill rod.

3. The rock drilling apparatus of claim 2, further comprising a guide bushing (32) made of anti-vibratory material arranged between said guiding means (33) and said tube (20).

4. The rock drilling apparatus of claim 3, wherein said guide bushing (32) and said guiding means (33) provide a slide bearing (34) permitting both rotary and axial motion between said drill bit (16) and said tube (20).

5. The rock drilling apparatus of claim 1, comprising at least one spacing means (23) arranged between said drill rod (18) and said tube (20) for guiding said drill rod (18) with said tube (20).

6. The rock drilling apparatus of claim 1, wherein said drill rod (18) and said tube (20) have a mutual axial play; and said guiding means (33) on said drill bit (16) has an axial extension exceeding said axial play.

7. The rock drilling apparatus of claim 5, wherein said spacing means comprise cushions (23) of elastic non-metallic material which are attached on said drill rod (18) extending in several directions.

8. The rock drilling apparatus of claim 4, wherein means are provided for leading a flushing medium through said annular space (35) between said drill rod (18) and said tube (20) towards said drill bit (16); and said rod (18) and said tube (20) are sealed to each other by means of a sealing ring (27) arranged between said adapter (24) and said rod (18) and by means of said bearing (24) which provides an essentially sealed contact between said tube (20) and said drill bit (16).

9. The rock drilling apparatus of claim 8, comprising at least one radially directed channel in said rear adapter (24) for supplying said flushing medium to said annular space (35).

10. The rock drilling apparatus of claim 8, comprising flushing holes (37) in said drill bit; and wherein the end of said drill rod (18) connected to said drill bit (16) has passage means (38; 40, 41) therein to transmit said flushing medium from said annular space (35) to said flushing holes (37) in said drill bit (16).

11. The rock drilling apparatus of any one of claims 8, 9 or 10, wherein said flushing medium comprises water.

* * * * *

UNITED STATES PATENT AND TRADEMARK OFFICE

CERTIFICATE OF CORRECTION

PATENT NO. : 4,387,775

DATED : June 14, 1983

INVENTOR(S) : Ebbe S. ADOLFSSON, et al

It is certified that error appears in the above-identified patent and that said Letters Patent is hereby corrected as shown below:

COLUMN 2, line 67, after "44. The", change "adapter rear" to --rear adapter--.

Signed and Sealed this

*Fourth* Day of *October 1983*

[SEAL]

*Attest:*

GERALD J. MOSSINGHOFF

*Attesting Officer*

*Commissioner of Patents and Trademarks*